US009267686B1

(12) United States Patent
Little et al.

(10) Patent No.: US 9,267,686 B1
(45) Date of Patent: Feb. 23, 2016

(54) APPARATUS AND METHOD FOR MONITORING FLARES AND FLARE PILOTS

(71) Applicant: ZEECO, INC., Broken Arrow, OK (US)

(72) Inventors: Cody L. Little, Coweta, OK (US); Kyle D. Jones, Coweta, OK (US); Scot K. Smith, Tulsa, OK (US); Andrew Beats, Sperry, OK (US); Clayton Francis, Broken Arrow, OK (US); Erin Lee, Bartlesville, OK (US)

(73) Assignee: ZEECO, INC., Broken Arrow, OK (US)

( * ) Notice: Subject to any disclaimer, the term of this patent is extended or adjusted under 35 U.S.C. 154(b) by 406 days.

(21) Appl. No.: 13/789,004

(22) Filed: Mar. 7, 2013

(51) Int. Cl.
*F23N 5/08* (2006.01)
*F23N 5/24* (2006.01)

(52) U.S. Cl.
CPC ..... *F23N 5/242* (2013.01)

(58) Field of Classification Search
CPC ..... F23N 2027/22; F23N 2029/00; F23N 2029/02; F23N 2029/04; F23N 2029/08; F23N 2029/18; F23N 2029/20; F23G 7/08; F23G 7/085
USPC ..... 431/5, 75, 79
See application file for complete search history.

(56) References Cited

U.S. PATENT DOCUMENTS 2,460,016 A * 1/1949 Kuhn ..... 431/192
2,869,631 A * 1/1959 Zink ..... 431/202
3,280,882 A * 10/1966 Hemker ..... 431/79
3,299,841 A * 1/1967 Hemker et al. ..... 431/75
3,816,059 A * 6/1974 Straitz, III ..... 431/278
4,140,471 A * 2/1979 Straitz et al. ..... 431/5
4,525,138 A * 6/1985 Snyder et al. ..... 431/187
4,756,684 A 7/1988 Nishikawa et al.
4,830,601 A * 5/1989 Dahlander et al. ..... 431/12
4,871,307 A * 10/1989 Harris et al. ..... 431/25
5,071,105 A * 12/1991 Donze et al. ..... 266/51
5,632,614 A 5/1997 Consadori et al.
5,829,962 A * 11/1998 Drasek et al. ..... 431/79
5,964,586 A * 10/1999 Ødemark et al. ..... 431/202
6,045,353 A 4/2000 VonDrasek et al.
6,164,957 A * 12/2000 Waters et al. ..... 431/13
7,777,977 B2 8/2010 Chase et al.
7,907,272 B2 3/2011 Zelepouga et al.

(Continued)

FOREIGN PATENT DOCUMENTS

EP 0 967 440 A2 12/1999

OTHER PUBLICATIONS

Bellovich, John, et al., "Flare Pilot System Safety", Process Safety Progress, Mar. 10, 2007, vol. 26, No. 1, US.

(Continued)

*Primary Examiner* — Jorge Pereiro
(74) *Attorney, Agent, or Firm* — Dennis D. Brown; Brown Patent Law, P.L.L.C.

(57) ABSTRACT

An apparatus and method for monitoring the status of one or more pilot flames or of the main flame in a flare system. A collimator, quartz light tube, or other receiver is positioned near the combustion zone and receives an image which is transmitted via a fiber optic line to an analyzing sensor which is located at a safe distance from the flare system. The fiber optic line preferably extends through a pilot gas line, a flame front generator line, or other protective conduit so that the fiber optic line can be cooled and purged by pilot gas, instrument air, or other cooling gas media which is continuously delivered through the conduit.

19 Claims, 7 Drawing Sheets

(56) References Cited

U.S. PATENT DOCUMENTS

| | | | | |
|---|---|---|---|---|
| 8,138,927 | B2 | 3/2012 | Diepenbroek et al. | |
| 8,274,560 | B2 | 9/2012 | Galfrascoli et al. | |
| 2003/0010015 | A1* | 1/2003 | Beck et al. | 60/204 |
| 2003/0036029 | A1* | 2/2003 | Hong et al. | 431/202 |
| 2005/0266363 | A1 | 12/2005 | Ganeshan | |
| 2008/0233523 | A1 | 9/2008 | Diepenbroek et al. | |
| 2009/0190186 | A1* | 7/2009 | Chase et al. | 358/474 |
| 2009/0309028 | A1* | 12/2009 | Venkoparao et al. | 250/338.5 |
| 2011/0085030 | A1* | 4/2011 | Poe et al. | 348/61 |
| 2012/0015308 | A1* | 1/2012 | Hong et al. | 431/5 |
| 2012/0174590 | A1* | 7/2012 | Krull et al. | 60/772 |
| 2012/0235042 | A1* | 9/2012 | Cole et al. | 250/340 |
| 2012/0262708 | A1* | 10/2012 | Connolly | 356/237.2 |
| 2012/0282555 | A1* | 11/2012 | Cody et al. | 431/5 |

OTHER PUBLICATIONS

Vandermeer, Willy, "Flame Safeguard Controls in Multi-Burner Environments", Apr. 1998, US.

Borg, Stephen E., et al., "A Fiber-Optic Probe Design for Combustion Chamber Flame Detection Applications", NASA/TM-2001-211233, Oct. 2001, US.

* cited by examiner

APPARATUS AND METHOD FOR MONITORING FLARES AND FLARE PILOTS

FIELD OF THE INVENTION

The present invention relates to apparatuses and methods for monitoring flare pilot burners and for monitoring flare systems.

BACKGROUND OF THE INVENTION

Process flare systems are widely used in the refining, chemical, petrochemical, petroleum production, and other industries for burning flammable and/or toxic materials which are released due to upset or startup conditions, or which are released simply as a result of the process itself. Flare stacks and other flare systems typically include one or more flare pilot burners which must remain in continuous operation in order to ignite the materials which are disposed of through the flare system.

A need exists for an apparatus and method for monitoring process flares and flare pilot burners which (a) provide reliable, instantaneous feedback, (b) are capable of identifying and monitoring each individual pilot burner in the flare system, as well as the flare itself, and (c) can be repaired, maintained or replaced without taking the flare system out of operation.

In order to prevent serious injury or illness resulting from the release of toxic substances, and to protect the plant personnel and the processing facility itself from harm due to fire and/or explosion, it is imperative that the operating status of the pilot burners used in the flare system, as well as the flare itself, be known or instantaneously determinable at all times. The systems heretofore available in the art for monitoring flares and flare pilot burners have involved (a) the use of long distance optics, (b) the use of thermocouples positioned in the combustion flames, or (c) flame rod ionization. Unfortunately, these existing systems and techniques have significant shortcomings and are not entirely reliable.

The optical monitoring systems currently employed in the art require the use of long distance lenses which are mounted at grade at a safe distance from the flare. Because of the distance involved, the viewing lens can be obstructed by fog, rain, snow, dust, smoke, or other conditions. The long distance viewing systems are also difficult to aim and are subject to movement over time. Further, the long distance viewing systems must be set to view an area large enough to account for significant differences in the actual position of the flame which can be caused by changing wind conditions. Consequently, for these and other reasons, the long distance viewing systems typically cannot adequately distinguish, for example, between the flame produced by a flare pilot burner versus the flame produced by the flare itself.

Thermocouple and flame rod ionization systems, on the other hand, require that the thermocouple or ionization rod be positioned in or substantially in the flame itself, thus causing rapid degradation which severely limits the useful life of these components. The replacement of such components is costly and is typically difficult, or sometimes impossible, to accomplish without taking the flare out of operation. Moreover, thermocouple and ion rod systems are also deficient in that (a) thermocouples do not provide sufficiently rapid temperature responses for instantaneous flame recognition and (b) ionization rods are viewed to be unreliable and prone to operational problems and difficulties in open environments.

SUMMARY OF THE INVENTION

The present invention provides an apparatus and a method for monitoring flare systems and flare pilot burners which satisfy the needs and alleviate the problems discussed above. The inventive apparatus and method provide instantaneous flame recognition and feedback, allow any number pilot burners, as well as the flare itself, to be independently monitored, do not require the placement of any monitoring components in the flare or pilot burner flame, allow on-line maintenance and replacement, and are unaffected by fog, rain, snow, dust, smoke, or other conditions.

In one aspect, there is provided an apparatus for monitoring a flare system comprising: (a) an image receiver which is oriented to receive an image of a combustion zone in a flare system or of a structure proximate to the combustion zone, the image receiver being positioned not more than 15 ft from the combustion zone; (b) an image analyzer spaced apart from the image receiver, preferably at a location outside of a heat affected zone of said flare system; (c) a fiber optic line extending from the image receiver to the image analyzer to transmit the image to the image analyzer, the fiber optic line comprising at least one optical fiber; and (d) a conduit having at least a portion of the fiber optic line positioned therein. As used herein and in the claims, the term "heat affected zone," refers to an area where (a) flame impingement from the flare system can occur or (b) temperatures in excess of 1000° F. can occur.

By way of example, but not by way of limitation, the inventive apparatus is well suited for use in an application wherein: the image is an image of a combustion zone of a pilot burner in the flare system; the conduit is a flare pilot gas line extending to the pilot burner; and the image receiver views the combustion zone of the pilot burner through one or more pilot gas delivery openings of the pilot burner.

In another aspect, there is provided an apparatus for monitoring a flare stack system comprising: (a) an image receiver which is positioned substantially at an upper end of the flare stack and is oriented to receive an image of a combustion zone at the upper end of the flare stack or of a structure proximate to the combustion zone; (b) an image analyzer spaced apart from the image receiver; and (c) a fiber optic line extending substantially from the image receiver to the image analyzer to transmit the image to the image analyzer, the fiber optic line comprising at least one optical fiber. The apparatus also preferably comprises a conduit extending upwardly toward the upper end of the flare stack and having at least a portion of the fiber optic line positioned therein.

By way of example, but not by way of limitation, the inventive apparatus for monitoring a flare stack system can be desirable employed wherein: the image is an image of a combustion zone of a pilot burner at the upper end of the flare stack; the conduit is a flare pilot gas line extending upwardly to the pilot burner; and the image receiver views the combustion zone of the pilot burner through one or more pilot gas delivery openings of the pilot burner.

In another aspect, there is provided a method of monitoring a flare system comprising the steps of: (a) receiving an image of a combustion zone in a flare system or of a structure proximate to the combustion zone using an image receiver which is positioned not more than 15 ft from the combustion zone; (b) transmitting the image, via a fiber optic line comprising at least one optical fiber, from the image receiver to an image analyzer spaced apart from the image receiver; and (c) analyzing the image using the image analyzer to determine whether a flame is present in the combustion zone.

Further aspects, features, and advantages of the present invention will be apparent to those of ordinary skill in the art upon examining the accompanying drawings and upon reading the following detailed description of the preferred embodiments.

DETAILED DESCRIPTION OF THE PREFERRED EMBODIMENTS

Figure 1:
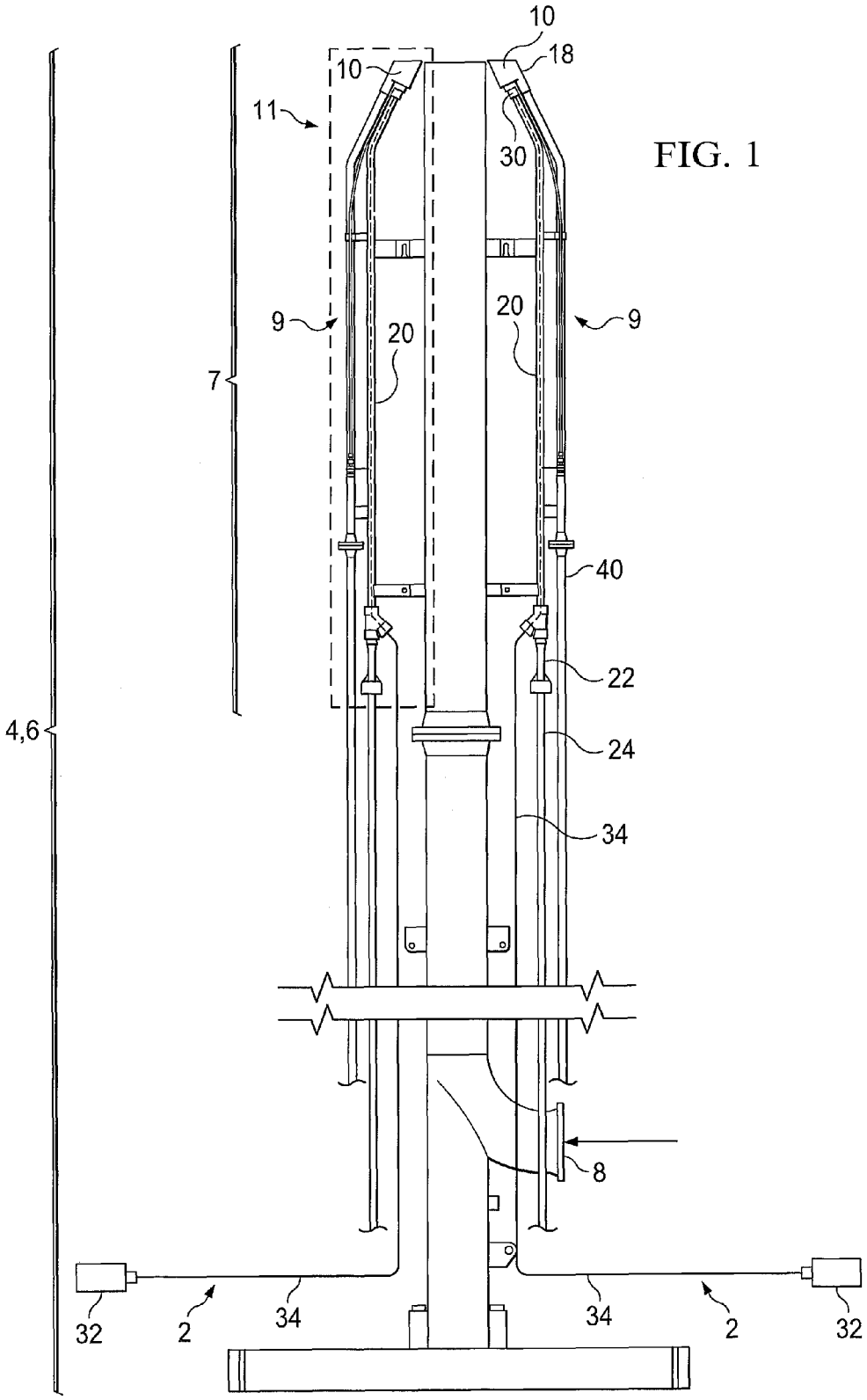
FIG. 1 is a cutaway, elevational schematic view of a flare stack system 4 having an embodiment 2 of the inventive monitoring system installed therein.

The inventive apparatus and method for monitoring flares and flare pilots can be used for monitoring flare stacks, ground flares, enclosed flares, bio-gas flares, and any other type of flare system. By way of example, but not by way of limitation, the drawings accompanying this specification illustrate various embodiments and arrangements of the inventive monitor for directly or indirectly monitoring the combustion zone of a flare pilot burner or the combustion zone of the flare itself.

In FIGS. 1-4, embodiments 2 of the inventive monitoring apparatus are illustrated as installed in a flare stack system 4 for monitoring the flare pilot burners 10. The flare stack system 4 comprises: a vertical flare stack 6 which can typically be anywhere in the range of from about 15 ft to about 400 ft in height; a flare combustion zone 5 at the top 11 of the flare stack 6; a delivery line 8 which delivers waste gas or released gas to the flare stack 6 sporadically (e.g., as a result of upset conditions, start-up conditions, or shut-down conditions in a plant process system), or delivers such gas to the flare stack 6 on some other intermittent, semi-continuous, or continuous basis; and one or more (preferably a plurality of) flare pilot burner assemblies 9 comprising pilot burners 10 located at the upper end 11 of the flare stack 6 for igniting the flared gas.

Each pilot burner 10 comprises a pilot burner tip 12 having openings 14 drilled or otherwise provided therethrough for delivering a combustible pilot gas into the pilot burner combustion zone 16 which projects outwardly from the exterior of the tip 12. In conjunction with the pilot burner 10, each flare pilot burner assembly 9 preferably further comprises: a flame shield or barrel 18 which surrounds and extends outwardly from the pilot burner tip 12; gas fuel supply line 24; a venturi mixer or other mixing device 22 for mixing the gas fuel (e.g., plant fuel gas) with air to produce a combustible pilot gas mixture; a pilot gas line 20 which extends up at least a top portion 7 of the flare stack 6 to the pilot burner 10 from the mixing device 22 to deliver the pilot gas to the pilot burner tip 12; and an electrical spark igniter or other flare ignition device 26 for igniting the pilot gas in the pilot combustion zone 16.

Figure 2:
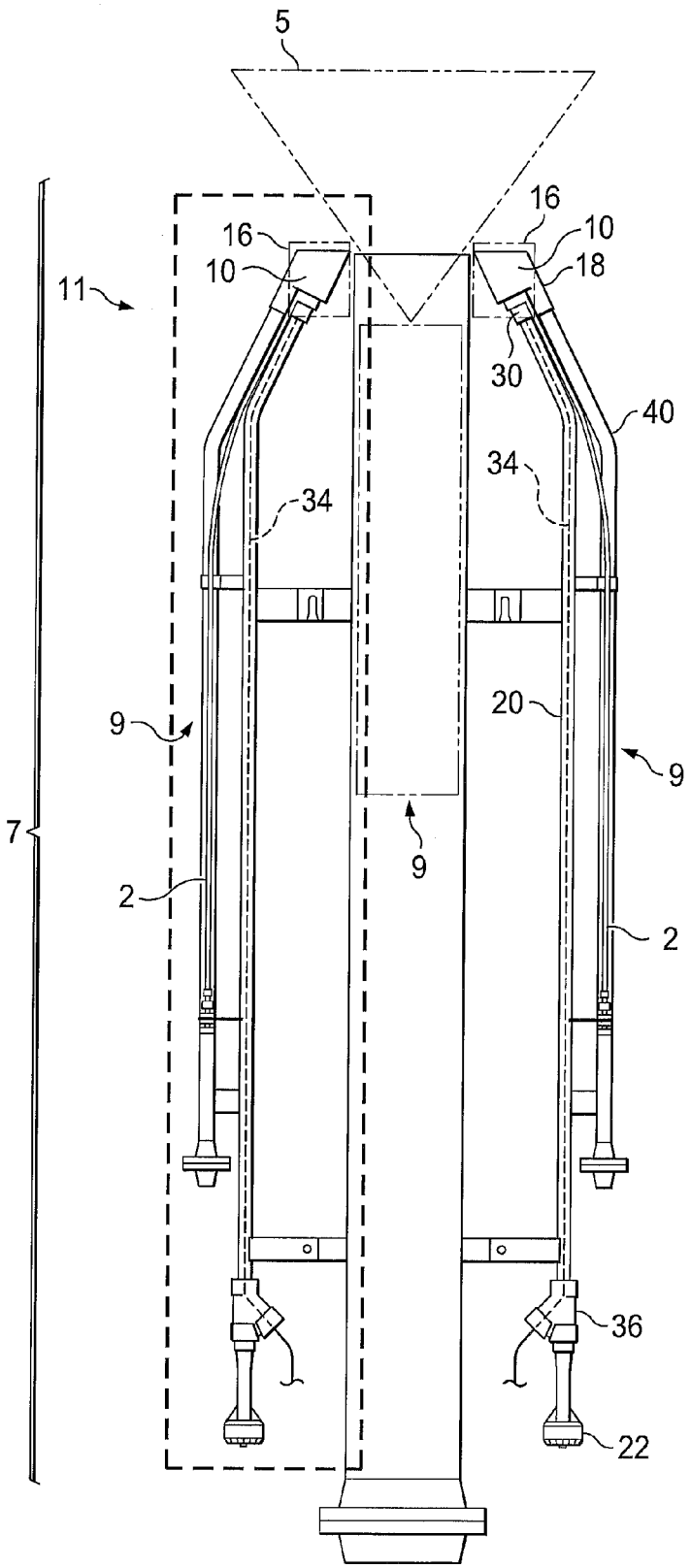
FIG. 2 is a cutaway, elevational schematic view of the upper portion of the flare stack system 4.
Figure 3:
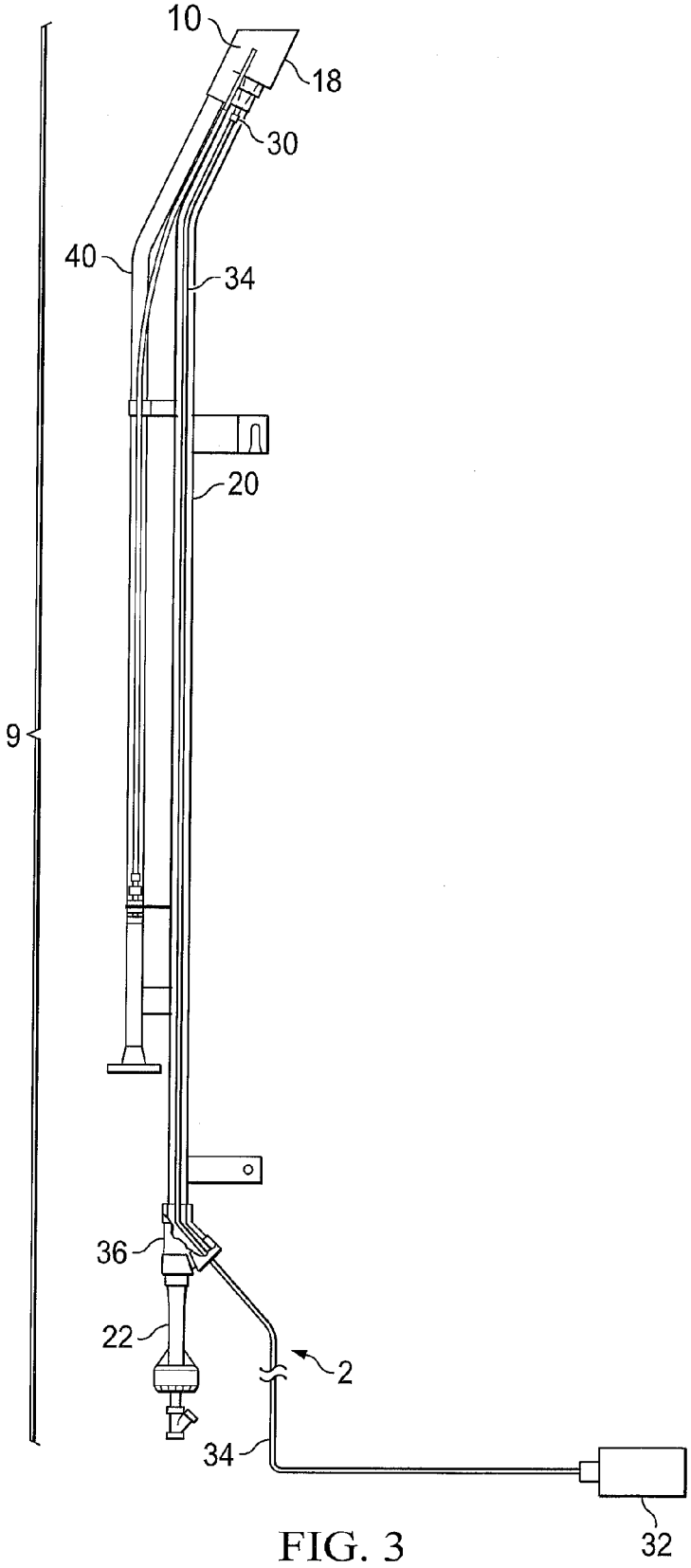
FIG. 3 is an enlarged cutaway, elevational schematic view of a pilot burner assembly 9 having an inventive monitor 2 installed therein.

In the flare stack system 4 illustrated in FIGS. 1 and 2, a separate inventive monitoring system 2 is preferably installed on each of the flare pilot burner assemblies 9 for independently monitoring the combustion zone 16 of each pilot burner 10. In each case, the inventive monitoring system 2 preferably comprises: an image receiver 30 which is preferably positioned at the upper end 11 of the flare stack 6, or is preferably within a distance of not more than 15 feet from the combustion zone 16, and is oriented for viewing the pilot combustion zone 16 or a heated structure adjacent to the combustion zone 16; an image analyzer 32 spaced some distance apart from the image receiver 30; and an elongate fiber optic transmission line 34 which extends from the image receiver 30 near the combustion zone 16 to the image analyzer 32. The image analyzer 32 is preferably positioned a safe distance from the flare and pilot burner combustion zones 5 and 6, i.e., preferably at least outside of the heat affected zone and most preferably outside of any radiation fence, safety enclosure, safety barrier, ladders, scaffolding, platforms, etc. associated with the flare system 4.

The image receiver receives an image of the combustion zone 16, or of a heated structure adjacent thereto, which is then transmitted to the image analyzer 32 via the fiber optic line 34. The image analyzer 32 analyzes the image to determine whether a flame is present in the combustion zone 16.

The image receiver 30 can be any type of device, assembly, or other structure or feature capable of receiving an image of the combustion zone 16, or of a structure (e.g., the interior or exterior of the pilot flame shield 18) which is adjacent to the combustion zone 16 and is heated by the combustion flame, for transmission of the image through the fiber optic line 34 to the image analyzer 32.

The image receiver 30 will preferably be a collimator or a heat resistant quartz light tube, or can be an exposed end (e.g., a cleaved and/or polished end) of the optical fiber itself. When viewing the combustion zone 16, the image which is received by the receiver 30 and transmitted to the image analyzer 32 will preferably be a combustion energy image. When viewing a structure (e.g., the pilot flame shield or barrel 18) which is sufficiently close to the combustion zone 16 that the structure will be heated very quickly whenever the pilot flame is present, the image which is received by the receiver 30 and transmitted to the image analyzer 32 will preferably be an infrared, ultraviolet, or other electromagnetic energy image of the surface of the heated structure.

The use of a heat resistant quartz light tube as an image receiver in the inventive monitoring system 2 is preferred whenever sufficient shielding and/or cooling of the fiber optic line 34 is not or cannot be provided near the flare or pilot combustion zone 5 or 16. The length of the quartz light pipe will preferably not be more than 20 ft and will more preferably be less than 5 ft. In addition, the quartz light tube can be straight, curved, or bent, and will preferably have a high thermal shock tolerance. The quartz light tube can also be insulated and wrapped, e.g., with an outer stainless steel jacket to provide additional mechanical integrity, thermal shock resistance, and high temperature tolerance.

Similarly, when a collimator is used as the image receiver 30 in the inventive monitoring system 2, the collimator will preferably also be specified for high temperature capability and high tolerance for thermal shock.

When the image transmitted to the image analyzer 32 by the fiber optic line 34 is an image of a combustion zone 5 or 16, the image analyzer 32 can be any type of instrument which is capable of determining from the image whether a flame is present in the combustion zone and transmitting this information, preferably through the generation of digital signals, to the system operator and/or to an automated monitoring and control system. The image analyzer 32 will preferably be capable of detecting the presence or absence of a flame and transmitting this information very quickly and will more preferably be capable of performing these operations substantially instantaneously. Examples of image analyzers preferred for use in the inventive monitoring system for detecting the presence or absence of a flame in combustion zone 5 or 16 include, but are not limited to, ultraviolet combustion sensors, infrared combustion sensors, or other types of electromagnetic wave sensors which can detect the presence of combustion.

Ultraviolet combustion sensors detect the presence of energy waves in the ultraviolet range and are also able to distinguish between the energy image produced by a flame versus an energy image received from the sun. However, ultraviolet measuring systems can be affected by the moisture and dust content of the air and therefore can be less reliable when used in an open, uncontrolled environment such as that encountered in flare system. But, on the other hand, when the combustion take place in an area surrounded by objects which will be at or near the combustion temperature, a UV system can distinguish between the flame and the hot surfaces. Consequently, ultraviolet combustion sensors are preferred for use in the inventive monitoring system 2 when the combustion zone is surrounded by such surfaces.

In contrast, if the image analyzer 32 used in the inventive monitoring system 2 is an infrared combustion sensor, the infrared combustion sensor will operate by detecting energy waves in the combustion image which are in the infrared range. The advantages of using an infrared combustion sensor are that (a) a greater amount of infrared energy is emitted a the combustion temperatures generated in the flare and pilot combustion zones 5 and 16 and (b) the infrared sensor will not be affected by the presence of dirty or moist air in the viewing path. However, a more precise viewing window may be required when using an infrared sensor in order to prevent false positive readings from the sun or from surrounding surfaces.

If, instead of receiving a direct image of a combustion zone 5 or 16, the image transmitted to the image analyzer 32 is a surface image of the flame shield 18 or other structure which is proximate to and is quickly heated by the combustion flame, the image analyzer 32 can still be an ultraviolet sensor, an infrared sensor, or other type of electromagnetic energy sensor. More preferably, the image analyzer 32 will be an infrared sensor which will operate to detect infrared energy emissions in the image of the heated surface in question.

In order to protect, shield, cool, and purge at least the segment of the fiber optic transmission line 34 which is in the high temperature region near the flare and pilot burner combustion zones 5 and 16, the fiber optic line 34 is preferably positioned within a conduit having a cooling and purge gas source connected thereto which continuously delivers a cooling and purge gas stream through the protective conduit. The purge gas can be any gas which will operate to adequately cool and purge the fiber optic line 34 and which will not interfere with the operation of the flare system 4 or the inventive monitoring system 2. Examples of gas media preferred for use in cooling and purging the fiber optic line 34 include, but are not limited to, (a) the pilot gas delivered to the pilot burners 10, (b) air (e.g., compressed air from the plant instrument air system), (c) premix gas and air used for ignition, or (d) an inert purge media such as $CO_2$ or $N_2$. In addition, the protective conduit can be a pipe, tube, or other conduit which already exists in the flare system or can be a new conduit which is added to the flare system for the purpose of shielding and/or cooling the fiber optic line 34.

For each of the inventive monitoring systems 2 illustrated in FIGS. 1-4 the conduit used for shielding and cooling the fiber optic transmission line 34 in the heat affected zone (typically at least the top 5 ft to 10 feet of the flare stack 6) is the pilot gas supply line 20 which extends up the top portion 7 of the flare stack, 6 to the pilot burner 10. When positioned within the pilot gas line 20, this portion of the fiber optic line 34 is cooled and purged by the pilot gas stream (i.e., a stream comprising gas fuel or a mixture of gas fuel and air) which continuously flows to the pilot burner 10 through the pilot gas line 20. An airtight Y-fitting or other airtight fitting 36 is preferably installed in the pilot gas line 20 which will allow the fiber optic line 34, as well as the image receiver 30 secured or formed on the distal end of the fiber optic line 34, to be inserted into and retracted from the pilot gas line 20, preferably at any time, without having to take the flare system 4 out of operation.

In the embodiment 2 of the inventive monitoring system shown in FIGS. 1-4 for monitoring the flame status of a pilot burner 10, the fiber optic line 34 and associated image receiver 30 secured or formed on the distal end thereof are delivered up the flare stack 6 and through the pilot gas supply line 20 until the image receiver 30 arrives at the upper end 11 of the flare stack 6 and is positioned either (a) in the upper end portion of the pilot gas line 20, or (b) within the pilot burner 10 beneath the burner tip 12, or (c) both. When placed in this position, the image receiver 30 views the pilot burner combustion zone 16 through one or more of the fuel openings 14 of the pilot burner tip 12.

Figure 5:
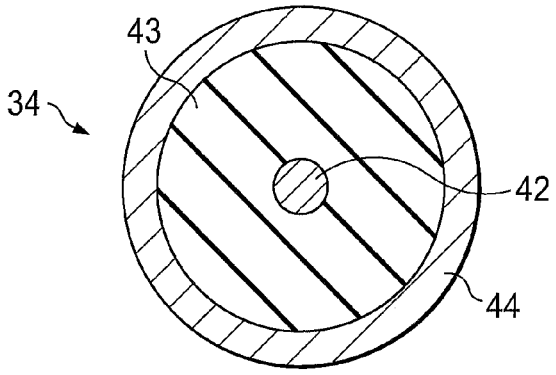
FIG. 5 is a cross-sectional view of an inventive fiber optic transmission line 34 used in the inventive monitoring system 5.
Figure 6:
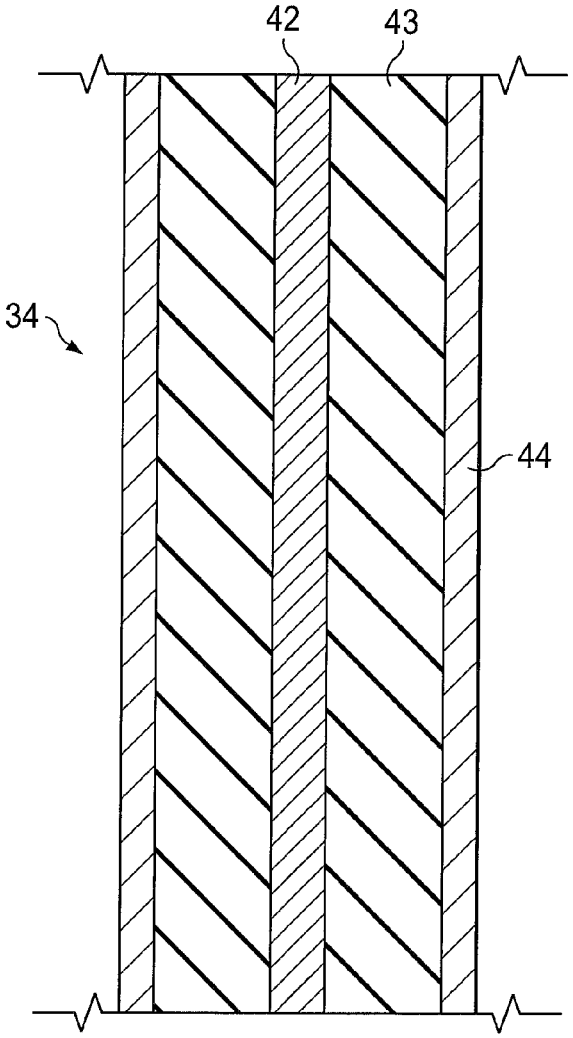
FIG. 6 is a cutaway elevational side view of the fiber optic transmission line 34.

As illustrated in FIGS. 5 and 6, the fiber optic transmission line 34 used in the inventive monitoring system 2 preferably comprises at least one optical fiber 42 having a protective covering 44 thereon. As will be understood by those in the art, the optical fiber(s) 42 of the fiber optic line 34 will preferably be formed of quartz or other high temperature material for transmission of infrared, ultraviolet, or other elected electromagnetic energy while being subjected to temperatures of up to 900° F. In addition, in order to allow the fiber optic transmission line 34 to be removably inserted into a pilot gas line 20, a fuel front generator line 40, or other protective conduit, the protective coating 44 of the fiber optic line 34 will preferably be formed of a corrosion and heat resistant metal, such as stainless steel or other high nickel alloy, which will bend to some degree but will be sufficiently rigid to be pushed into position up the flame stack 6.

An insulating material 43 will also preferably be packed between the optical fiber 42 and the sheath 44 of the transmission line 34. The insulating material 43 will preferably be a ceramic or oxide insulating material in powdered or small fiber form which will (a) provide flexibility; (b) protect the optical fiber 42 from heat and electromagnetic interference; and (c) keep the fiber 42 centered in the sheath 44.

Figure 4:
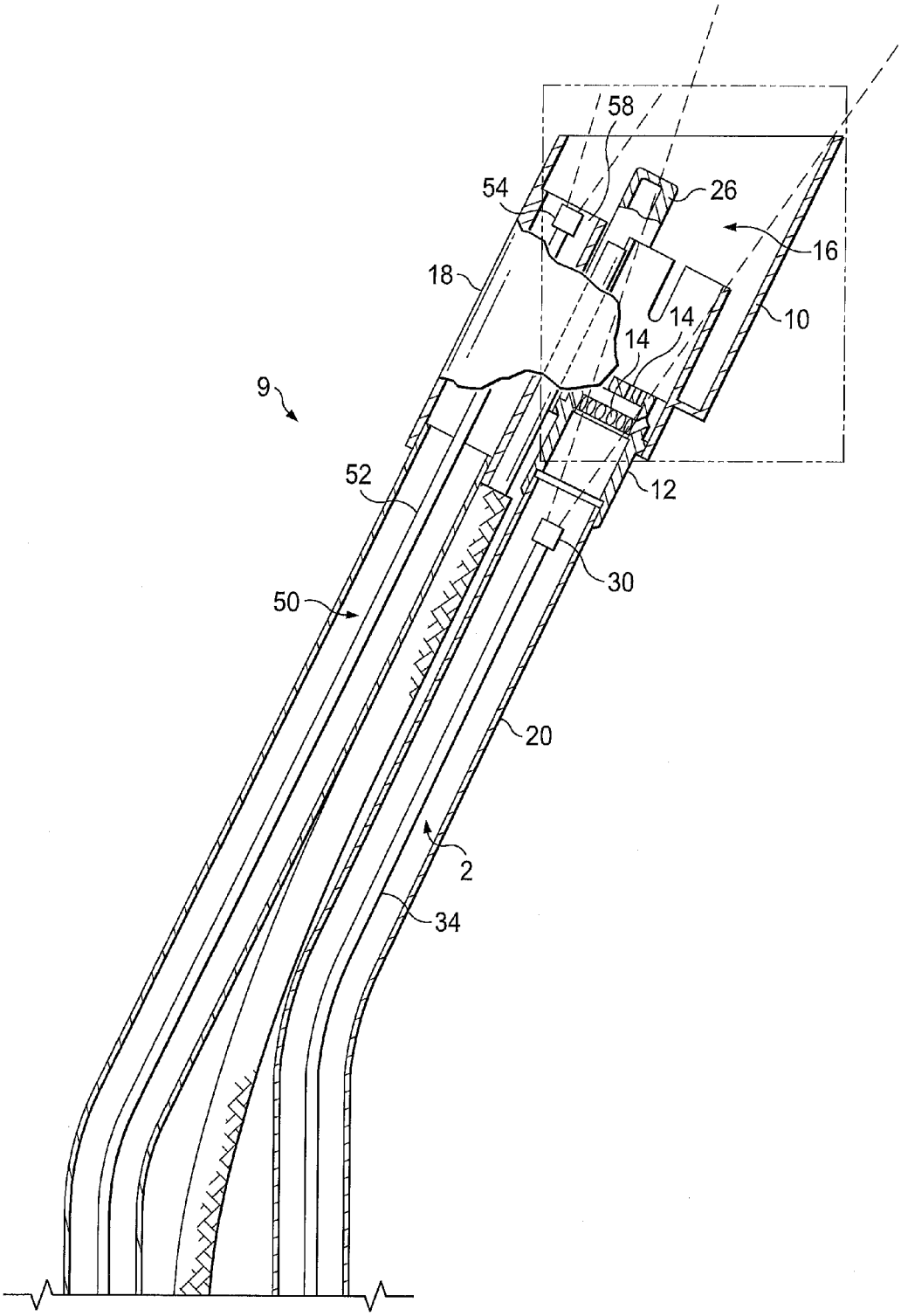
FIG. 4 is a cutaway, elevational schematic view of an upper end portion of a pilot burner assembly 9 having alternative embodiments 2 and 50 of the inventive monitoring system installed therein.
Figure 7:
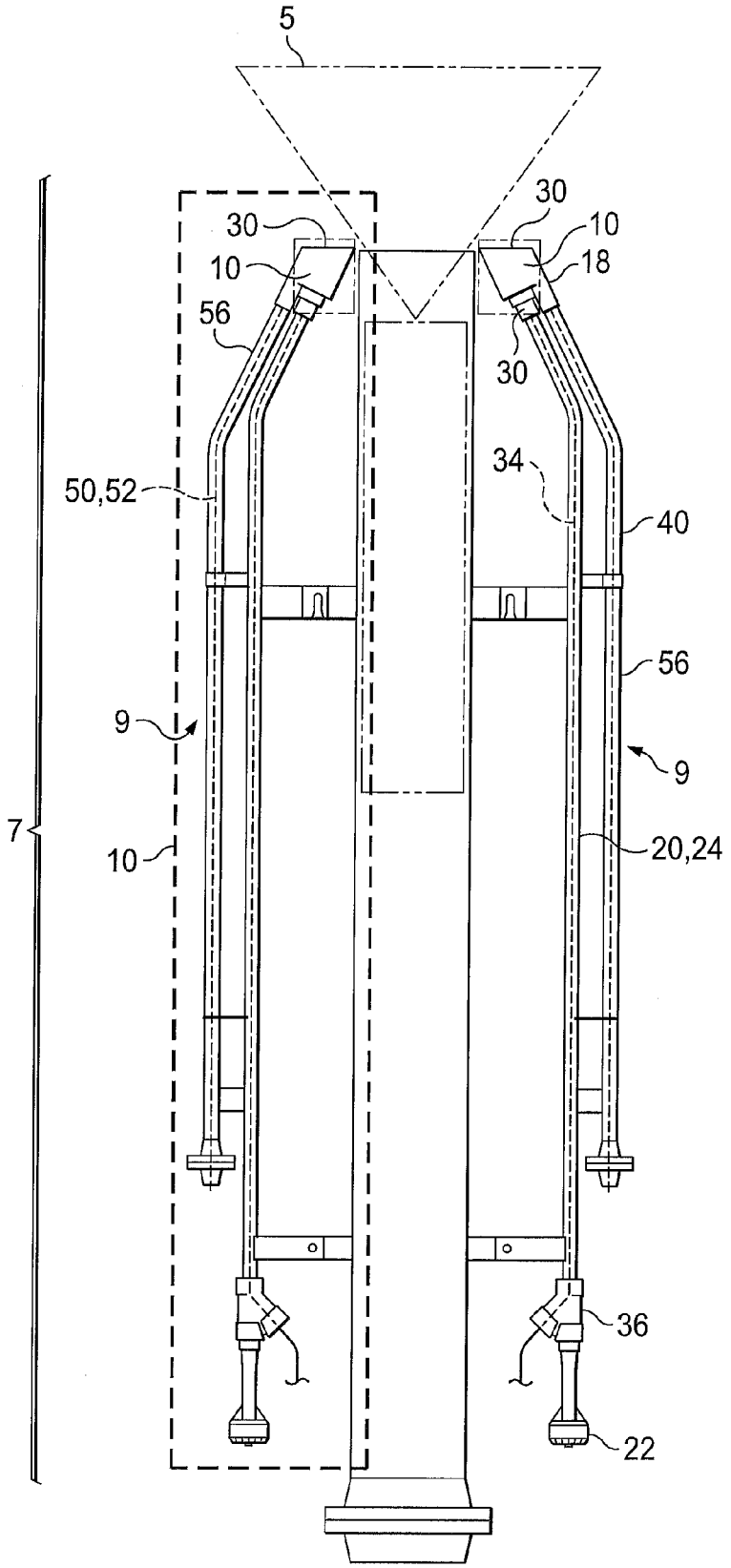
FIG. 7 is a cutaway, elevational schematic view of the upper portion of the flame stack system 4 having both of embodiments 2 and 50 of the inventive monitoring system installed therein.

An alternative embodiment 50 of the inventive monitoring system is depicted in FIGS. 4 and 7. The embodiment 50 illustrated in FIGS. 4 and 7 is substantially identical to the embodiment 2 depicted in FIGS. 1 and 4 except that the fiber optic transmission line 52 of the inventive monitor 50 is delivered up the flare stack 6 by removably inserting the fiber optic line 52 and the image receiver 54 attached or formed on the end thereof upwardly through a flame front generator line 56 of a pilot burner assembly 9.

As will be understood by those in the art, a flame front generator line can be used for igniting a flare pilot burner by igniting a combustible mixture within the flame front generator line such that the resulting fireball, or flame front, travels through the ignition line to the pilot. However, except when the use of the flame front generator line 56 is needed for reigniting the pilot burner 10, the fiber optic line 52 and image receiver 54 can be removably delivered through and housed in the flame front generator line 56. In addition, instrument air or any other desired cooling gas medium can be delivered through the flame front generator line 56 for cooling and purging the fiber optic line 52 during flare operation.

Because of the unrestricted top opening 58 of the flame front generator line 5, an image receiver 54 positioned in the upper end of the flame front generator line 56 at the top of the flare stack 6 can be readily oriented for viewing the flare combustion zone 5 or a structure adjacent to the flare combustion zone 5, independent of the pilot combustion zone 16. Alternatively, however, because of the proximity to the pilot burner flame stabilization shield 18, the receiver 54 positioned at the upper end of the flame front generator line 56 can instead, if desired, be oriented to monitor the pilot burner 10 by viewing the surface of the pilot flame shield 18, independent of the flare combustion zone 5.

Figure 8:
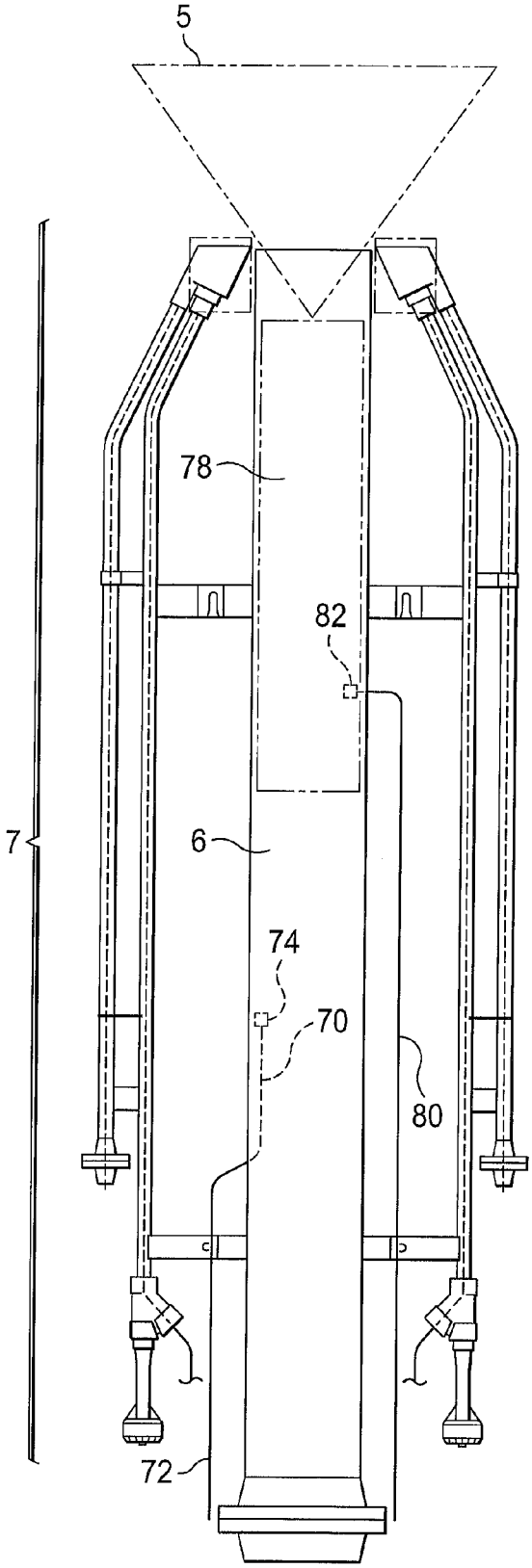
FIG. 8 is a cutaway, elevational schematic view of the upper portion of the flare stack system 4 having an embodiment 70 of the inventive monitoring system installed therein.

In yet another alternative embodiment 70 of the inventive monitor illustrated in FIG. 8, the fiber optic line 72 of the inventive monitor 70 and the image receiver 74 attached or formed on the end of the fiber optic line 72 are extended upwardly into the flare stack 6 itself. In this arrangement, the image receiver 74 is oriented upwardly for viewing the flare combustion zone 5. Also, in order to further determine whether the flare system 4 is operating properly or whether any burn-back may be occurring in the burn-back zone 78 within the upper end portion of the flare stack 6, the image receiver 82 of another inventive monitor 80 can be inserted through the side wall of the flare stack 6 in the burn-back zone 78 and oriented in a lateral direction (i.e., preferably substantially perpendicular to the flare stack 6) for solely viewing the burn-back zone 78.

In the method of the present invention, the fiber optic transmission line 34, 52, or 72 having an image receiver 30, 54, or 74 attached or formed on the distal end thereof is inserted through or into a pilot gas line 20, a flame front generator line 40, the flare stack 6, or other conduit until the image receiver 30, 54, or 74 is preferably not more than 15 ft, more preferably not more than 5 ft and most preferably not more than 2 ft from a pilot combustion zone 16 or the flare combustion zone 5. During the operation of the flare system, the image receiver 30, 54 or 74 continuously receives an image of the combustion zone 5 or 16, or of a heated structure adjacent to the combustion zone, which is continuously transmitted via the fiber optic line 34, 54, or 74 to an image analyzer 32. The image analyzer 32 is spaced a distance apart from the image receiver and is preferably located at least outside of the heat affected zone of the flare system 4. The image is analyzed by the image analyzer to determine whether a flame is present in the combustion zone 5 or 16.

Also, during this operation, pilot gas, instrument air, or another suitable cooling gas medium is preferably continuously delivered through the pilot gas line 20, the fuel front generator line 56, or other conduit which houses the fiber optic line 34, 52, or 72 in order to continuously cool and purge the fiber optic line 34, 52, or 72. The cooling of the fiber optic line 34, 52, or 72 allows the fiber optic line 34, 52, or 72 and image receiver 30, 54, or 74 to be positioned in close proximity to the combustion zone 5 or 16 for a close-up view of the individual combustion zone 5 or 16, or a structure adjacent thereto, apart from the other pilot and/or flare combustion zones present in the flare system.

In addition, the inventive method can further comprise the steps of removing the fiber optic line 34 and image receiver 30 from the pilot gas line 40 or other protective conduit and replacing or reinserting the fiber optic line 34 and/or image receiving element 30 in the flare pilot gas line 40 or other conduit via a Y-fitting or other airtight fitting 42 which is installed in the protective conduit. The selective insertion and removal of the fiber optic line 34 can be performed while the flare system remains in operation or when the system is shut down.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the invention as defined by the claims.

What is claimed is:

1. An apparatus for monitoring a vertical flare stack system comprising:

a vertical flare stack comprising a delivery line for delivering a flare gas comprising a waste gas, a released gas, or a combination thereof to an upper end of said vertical flare stack, said upper end of said vertical flare stack having a height of at least 15 feet, said delivery line having an open upper end at said upper end of said vertical flare stack for discharging said flare gas, and said vertical flare stack having a flare combustion zone projecting upwardly from said upper end of said vertical flare stack wherein said flare gas is combusted;

an image receiver which is positioned not more than 5 feet from a monitored combustion zone at said upper end of said vertical flare stack and is oriented to receive an image of said monitored combustion zone at said upper end of said vertical flare stack or of a heated structure at said upper end of said vertical flare stack proximate to said monitored combustion zone;

an image analyzer;

a fiber optic line extending from said image receiver to said image analyzer to transmit said image to said image analyzer, said fiber optic line comprising at least one optical fiber; and a conduit extending upwardly to said upper end of said vertical flare stack and having at least an upper end portion of said fiber optic line positioned therein.

2. The apparatus of claim 1 wherein said image is an image of said monitored combustion zone and wherein said image analyzer comprises an ultraviolet sensor an infrared sensor.

3. The apparatus of claim 1 wherein:

said image of said monitored combustion zone is an image of a pilot combustion zone of a pilot burner, said pilot burner being located at said upper end of said vertical flare stack adjacent to said flare combustion zone for igniting said flare gas discharged from said open upper end of said delivery line;

said conduit is a pilot gas line extending upwardly to said pilot burner; and said image receiving element views said pilot combustion zone of said pilot burner through one or more pilot gas delivery openings of said pilot burner.

4. The apparatus of claim 3 wherein said image receiver is a collimator secured on a distal end of said optical fiber.

5. The apparatus of claim 3 wherein said image receiver is a quartz light tube secured on a distal end of said optical fiber.

6. The apparatus of claim 3 further comprising an airtight fitting in said pilot gas line which is openable and closeable during operation of said vertical flare stack, said fiber optic line extending into said pilot gas line through said fitting.

7. The apparatus of claim 6 wherein said fiber optic line further comprises a protective metal covering on said optical fiber and said fiber optic line and said image receiver can be inserted into and removed from said pilot gas line through said fitting while said vertical flare stack is in operation.

8. The apparatus of claim 1 wherein said conduit is a flame front generator tube for said vertical flare stack, said flame front generator tube having an unrestricted top opening at said upper end of said vertical flare stack.

9. The apparatus of claim 8 wherein said monitored combustion zone is said flare combustion zone.

10. The apparatus of claim 1 wherein:

said image is an image of a structure proximate to said monitored combustion zone and said image analyzer comprises an infrared sensor.

11. A method of monitoring a vertical flare stack system comprising the steps of:

(a) receiving an image of a monitored combustion zone located at an upper end of a vertical flare stack or of a heated structure proximate to said monitored combustion zone using an image receiver, said vertical flare stack comprising a delivery line which delivers a flare gas comprising a waste gas, a released gas, or a combination thereof to said upper end of said vertical flare stack, said upper end of said vertical flare stack having a height of at least 15 feet, said delivery line having an open upper end at said upper end of said vertical flare stack from which said flare gas is discharged, and said vertical flare stack having a flare combustion zone projecting upwardly from said upper end of said vertical flare stack in which said flare gas is combusted;

(b) transmitting said image, via a fiber optic line comprising at least one optical fiber, from said image receiver to an image analyzer, wherein said image receiver is formed on or secured to an upper distal end of said fiber optic line and at least an upper end portion of fiber optic line is positioned in a conduit extending upwardly to said upper end of said vertical flare stack;

(c) cooling said upper end portion of said fiber optic line by contacting said fiber optic line with a gas flowing through said conduit; and (d) analyzing said image using said image analyzer to determine whether a flame is present in said monitored combustion zone.

12. The method of claim 11 wherein said image is an image of said monitored combustion zone and wherein said image analyzer assembly comprises an ultraviolet sensor.

13. The method of claim 11 wherein:

said image is an image of said monitored combustion zone;

said monitored combustion zone is a combustion zone of a pilot burner at said upper end of said vertical flare stack; and said conduit is a pilot gas line having pilot gas flowing therethrough which is delivered to said pilot burner and which contacts and cools said upper end portion of said fiber optic line in accordance with step (c); and said image receiver is positioned in said pilot burner, in said pilot gas line for said pilot burner, or in both said pilot burner and said pilot gas line, such that said image receiver receives said image in step (a) by viewing said combustion zone through one or more pilot gas delivery openings of said pilot burner.

14. The method of claim 13 wherein said image receiver comprises a collimator, a quartz light tube, or an exposed end of said optical fiber.

15. The method of claim 13 wherein:

an airtight fitting is provided in said pilot gas line;

said fiber optic line further comprises a protective metal covering on said optical fiber; and said method further comprises the steps, while said vertical flare stack is in operation, of removing said fiber optic line from said flare pilot gas line through said fitting and replacing said fiber optic line in said flare pilot gas line through said fitting.

16. The method of claim 11 wherein said conduit is a flame front generator tube for said vertical flare stack, said flame front generator tube having an unrestricted top opening at said upper end of said vertical flare stack.

17. The method of claim 16 wherein said method further comprises the step of cooling said upper end portion of said fiber optic line by delivering a cooling medium through said flame front generator tube.

18. The method of claim 11 wherein said image receiver is positioned at said upper end of a flare stack.

19. An apparatus for monitoring a flare stack system comprising:

an image receiver which is positioned substantially at an upper end of a flare stack and is oriented to receive an image of a combustion zone at said upper end of said flare stack or of a structure at said upper end of said flare stack proximate to said combustion zone;

an image analyzer;

a fiber optic line extending from said image receiver to said image analyzer to transmit said image to said image analyzer, said fiber optic line comprising at least one optical fiber; and a conduit extending upwardly toward said upper end of said flare stack and having at least a portion of said fiber optic line positioned therein;

wherein said image is an image of a combustion zone of a pilot burner at said upper end of said flare stack, said conduit is a pilot gas line extending upwardly to said pilot burner;

said image receiving element views said combustion zone of said pilot burner through one or more pilot gas delivery openings of said pilot burner said combustion zone is a first combustion zone, said image receiver is a first image receiver, and said fiber optic line is a first fiber optic line, said apparatus further comprises a second image receiver, different from said first image receiver, which is positioned substantially at said upper end of said flare stack and is oriented to receive an image of a second combustion zone at said upper end of said flare stack or of a structure at said upper end of said flare stack proximate to said second combustion zone, said second combustion zone being different from said first combustion zone and said apparatus further comprises a second fiber optic line extending from said second image receiver to an image analyzer, at least a portion of said second fiber optic line being positioned in a conduit extending upwardly toward said upper end of said flare stack.

* * * * *